US007494452B2

(12) United States Patent
Kemery et al.

(10) Patent No.: US 7,494,452 B2
(45) Date of Patent: Feb. 24, 2009

(54) HAND WEIGHT WITH CONTOURED OPPOSING WEIGHT PROTRUSIONS

(75) Inventors: Michael Kemery, Portland, OR (US); Ryan C. Coulter, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/250,200

(22) Filed: Oct. 14, 2005

(65) Prior Publication Data

US 2007/0087917 A1 Apr. 19, 2007

(51) Int. Cl.
*A63B 21/072* (2006.01)

(52) U.S. Cl. ..... 482/108; 482/106; D21/680

(58) Field of Classification Search ..... 482/44–50, 482/106, 108, 141; D21/680–2, 684; D8/DIG. 10, D8/303, 80, 83, 107, 315; 81/489; 601/135, 601/137; D24/214, 215; 16/430, 435–6
See application file for complete search history.

(56) References Cited

U.S. PATENT DOCUMENTS 1,161,270 A * 11/1915 Vance ..... 16/435
1,424,676 A * 8/1922 Parsons ..... 81/125.1
1,802,832 A * 4/1931 Priddle ..... 81/125.1
1,802,835 A * 4/1931 Roberts ..... 52/766
3,588,102 A * 6/1971 Giffod ..... 482/106
4,305,582 A * 12/1981 Barton ..... 446/486
4,517,862 A * 5/1985 Garcia ..... 81/119
4,867,444 A * 9/1989 Castillo ..... 482/106
D340,636 S * 10/1993 Ming-Chang ..... D8/303
5,403,008 A * 4/1995 Mainiero ..... 473/201
5,630,343 A * 5/1997 Begin ..... 81/57.46
5,823,077 A * 10/1998 Macor ..... 81/177.1
5,823,922 A 10/1998 Eckmann
5,829,099 A * 11/1998 Kopelman et al. ..... 16/430
5,876,310 A * 3/1999 Mackey et al. ..... 482/74
D418,881 S * 1/2000 Cousins ..... D21/681
6,101,909 A * 8/2000 Djie ..... 81/489
D445,014 S * 7/2001 Douglas et al. ..... D8/107
6,537,117 B1 * 3/2003 Larson et al. ..... 440/101
D478,494 S * 8/2003 Arnold ..... D8/107
6,647,834 B2 * 11/2003 Hu ..... 81/119
D485,144 S * 1/2004 Levine et al. ..... D8/28
6,682,464 B2 * 1/2004 Shifferaw ..... 482/106
D498,273 S * 11/2004 Kuo ..... D21/681
D531,365 S * 10/2006 Axelrod ..... D30/160
2004/0198567 A1 * 10/2004 Landfair ..... 482/106

* cited by examiner

*Primary Examiner*—Loan H Thanh
*Assistant Examiner*—Allana Lewin
(74) *Attorney, Agent, or Firm*—Plumsea Law Group, LLC

(57) ABSTRACT

A hand weight with a central grip area and contoured opposing weight portions at the ends so as to convey a "Z"-shaped profile. The asymmetry of the hand weight results in a shape that is more open to accommodate a larger range of hand sizes and to more comfortably fit into the hand for a variety of holds. The shape of the end portions also results in an overall shape that is less obstructive of movements since it has a narrower profile when rotated appropriately. One of the ends is configured with a flat section to enable the weight to be positively and stably set on a flat surface and prevent rolling.

12 Claims, 4 Drawing Sheets

HAND WEIGHT WITH CONTOURED OPPOSING WEIGHT PROTRUSIONS

BACKGROUND OF THE INVENTION

1. Field of the Invention

The present invention relates to exercise equipment and more particularly, to a hand weight for general fitness use providing resistance to movement.

2. Background of the Invention

Hand weights are used to provide weight based resistance to movement to increase the intensity of exercise. Hand weights are used in strength building, toning, shaping and firming exercises, as well as to increase the cardiovascular intensity of running or walking. Activities such as weight training, aerobics, toning and any fitness instruction, whether group or personal, may require weight. Fixed weight hand weights range from one-half pound up to 20 pounds or more for a set, generally in half pound or one pound increments. For toning, sculpting and firming exercises, three, five and eight pound hand weights are commonly used. Whatever the weight, hand weights typically have a center bar with cylindrical weights at the ends to provide an H-shaped profile. Some have weights at the ends which are polygonal in cross-section. The conventional shape of hand weights reduces the effective gripping area of the center bar, and the protruding weights at the ends of the bar can obstruct free movement during exercise.

As expected of a generally cylindrical shape, a conventional hand weight is symmetrical with respect to a vertical plane extending through a center line, about a horizontal plane extending through a center line, and symmetrical about a longitudinal axis. The longitudinal axis of a conventional hand weight at rest typically coincides with a horizontal axis.

One of the objects of the invention is to provide a hand weight that provides an increased effective gripping area to accommodate a larger range of hand sizes. Another one of the objects of the invention is to provide a hand weight with a shape that is more open and less obstructive than traditional weights.

Conventional cylindrical hand weights also tend to roll around easily and increase the possibility of mishaps from the equipment which can lead to injury. Yet another object of the invention is to provide a hand weight designed to prevent accidental rolling and potential injury.

SUMMARY

In accordance with the present invention, a hand weight has a central grip area and weight portions at the ends but is asymmetrical with respect to both horizontal and vertical planes, and a longitudinal axis. Each end is flared out and its contours extend beyond the central grip area only on one side. The two ends are flared and contoured in opposite directions so as to convey a "Z"-shaped profile to the weight. The asymmetry of the hand weight results in a shape that is more open to accommodate a larger range of hand sizes. The effective gripping area of the weight extends further than the corresponding area of a conventional weight with an H-shaped profile. In contrast to conventional hand weights, the longitudinal axis of the hand weight of the present invention is angled with respect to the horizontal. The central grip portion of the hand weight is overlaid with material to enhance the grip and reduce the likelihood of slipping when wet.

The asymmetry and the shape of the end portions also results in an overall shape that is less obstructive of movements since it has a narrower profile when rotated appropriately. This is especially advantageous for toning and firming exercises where stability and form are important, and in which the hand weight is held close and passes close to the body during repetitions.

In addition to the advantages of the asymmetrical design when the hand weight is gripped in the traditional way, i.e., generally parallel to the floor, the present invention also provides a more comfortable and ergonomic feel when the hand weight is held in other ways. For example, for some exercises, it is desired to hold the hand weight generally perpendicular to the floor by ringing the forefinger and thumb and hanging the weight from that ring such that the flared end portion of the weight rests mostly on just those two fingers. The smoothly contoured, asymmetrical end portions more comfortably fit within the user's hand when the weight is held in this manner as compared to typical cylindrically shaped weights. The same holds true with regard to other ways of gripping the hand weight.

To ensure that the hand weight does not accidentally roll, one of the ends is configured with a flat section to enable the weight to be positively and stably set on a flat surface.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
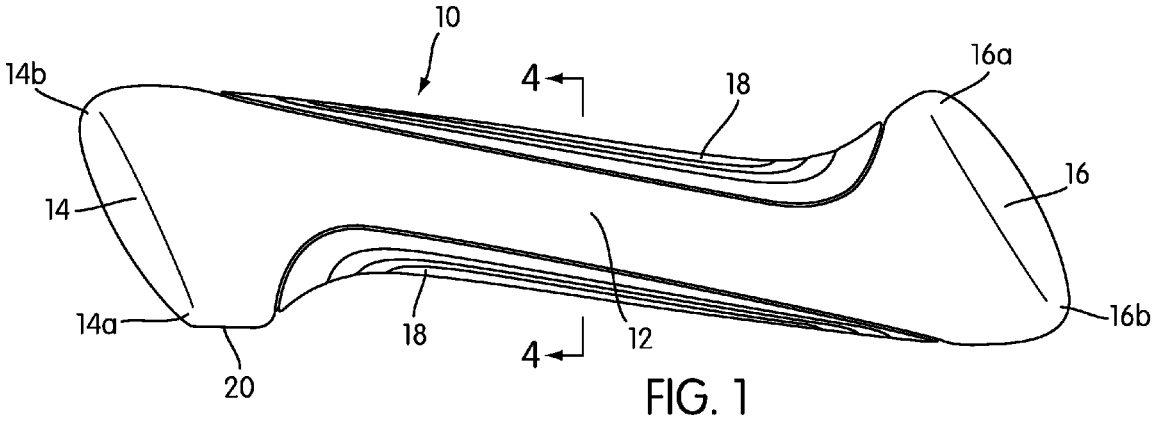
FIG. 1 is a side elevational view of a hand weight in accordance with the present invention.
Figure 2:
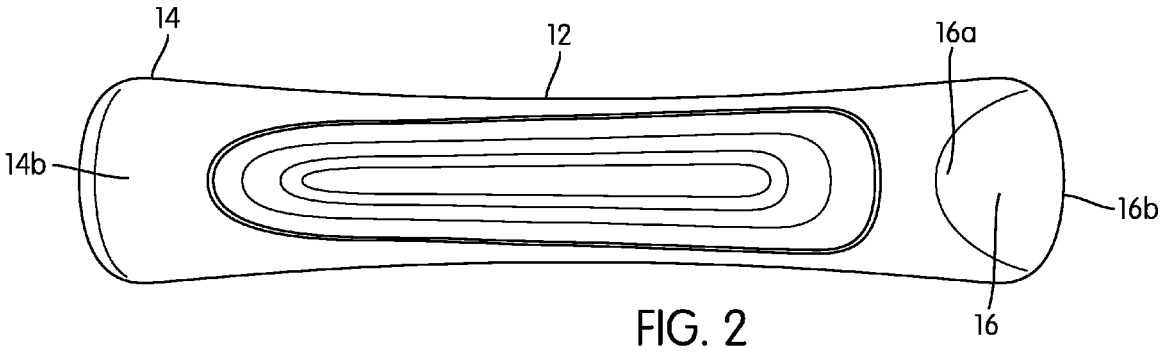
FIG. 2 is a top plan view thereof.

Referring to FIGS. 1-7, hand weight 10 comprises a central grip area 12 and integrally formed weight portions 14, 16 at the ends. For clarity of description various directional adjectives such as "top" and "bottom" and "left" and "right" will be used herein with respect to the orientation of hand weight 10 as illustrated in the drawings. It will be understood that these adjectives refer to the hand weight at rest on a stable surface as illustrated, and may not apply to the hand weight's orientation while being used. The x, y and z reference lines and planes marked in FIGS. 4-7 also refer to the illustrated orientation, although the longitudinal axis L of the body of hand weight 10 is a self-contained reference regardless of orientation.

Figure 3:
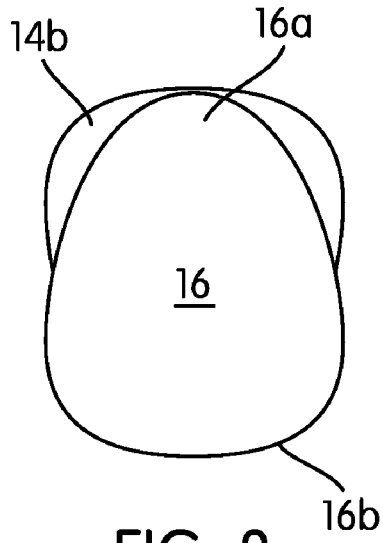
FIG. 3 is an end elevational view thereof.

Top and bottom surfaces of central grip area 12 are provided with grip enhancing pads 18. Weight portions 14, 16 are formed to protrude on opposing sides of central grip area 12 such that hand weight 10 has a "Z"-shaped profile, FIG. 1. Weight portion 14 protrudes downward in FIG. 1 from central grip area 12, and weight portion 16 protrudes upward. The protrusion each have a tip 14*a*, 16*a* and a seat 14*b*, 16*b*. Tips 14*a* and 16*a* extend outward from central grip area 12 while seats 14*b* and 16*b* are flush with central grip area 12. A view of end portion 16 from the end, FIG. 3, shows that tip 16*a* is narrower in cross-section than seat 16*b* thereby lending a generally triangular shape to end portion 16. End portion 14 is similarly shaped.

Figure 5:
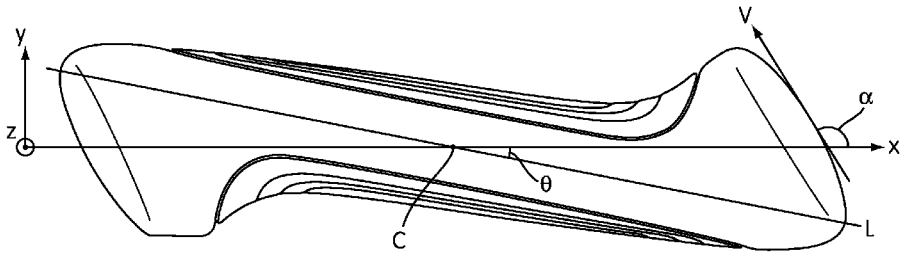
FIG. 5 is a side elevational view like FIG. 1 marked with reference lines and planes.
Figure 7:
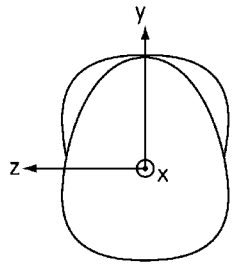
FIG. 7 is an end elevational view like FIG. 3 marked with reference lines and planes.

Because tips 14*a* and 16*a* are formed on opposing sides of the hand weight, when hand weight 10 is set on a flat surface as illustrated, tip 14*a* and seat 16*b* face downward and contact the surface. For convenience of description this will be referred to as the "rest" position. Longitudinal axis L of hand weight 10 extends through the comers of seats 14*b* and 16*b*, as illustrated in FIG. 5, and is therefore angled relative to the horizontal axis x at an angle θ. Angle θ is preferably greater than 1°, and is approximately 9° in the illustrated embodiment. Each end surface of hand weight 10 extending along line V in FIG. 5 is also angled relative to the x axis at an angle α which is preferably greater than 90°, and is approximately 116° in the illustrated embodiment. This of course means that the end surfaces are also angled from the vertical y axis. The opposing relationship of the protrusions and the resulting angled body of hand weight 10 with respect to the horizontal lends the present invention the "Z"-shaped profile.

Figure 8:
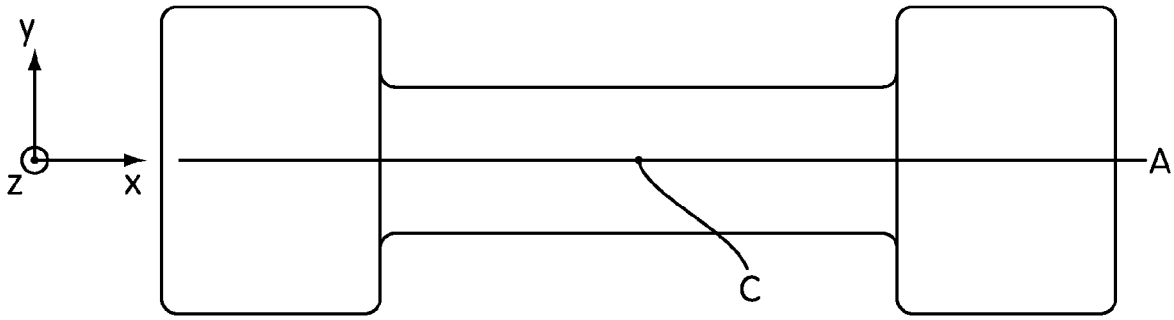
FIG. 8 PRIOR ART
FIG. 8 is an elevational view of a conventional cylindrical hand weight.
Figure 9:
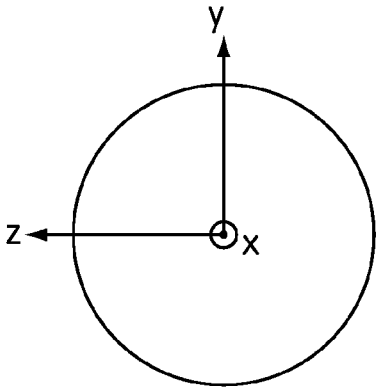
FIG. 9 PRIOR ART
FIG. 9 is an end elevational view of a conventional cylindrical hand weight.

Typical prior art hand weights have weight protrusions that are equally distributed at the ends of the central bar to lend an "H"-shaped profile to the weight at rest, FIGS. 8 and 9. Since the larger cylinders of the weighted ends are axially aligned with the cylinder of the central bar, a longitudinal axis A is horizontal at rest and therefore coincides with or is parallel to the x-axis. The end surfaces of the weight protrusions of the prior art weight are vertical. The axially aligned cylinders of the prior art weights are also symmetrical about the x-axis, i.e., the overall shape is a surface of revolution since the surface can be generated by rotating a two-dimensional curve about the x-axis. In the illustrated example, the two-dimensional curve would be the top half of the "H"-shape in FIG. 8 rotated about the x-axis. In mathematical terms, for all surfaces of revolution, the resulting surface is said to have azimuthal symmetry.

In contrast, hand weight 10 has a more complex shape and is azimuthally asymmetric as there is no two-dimensional curve that could be rotated about an axis to result in this shape. Compared to the traditional dumbbell shape, the opposing protrusion configuration of the present invention provides more clearance for certain movements, particularly those close to the body.

Figure 6:
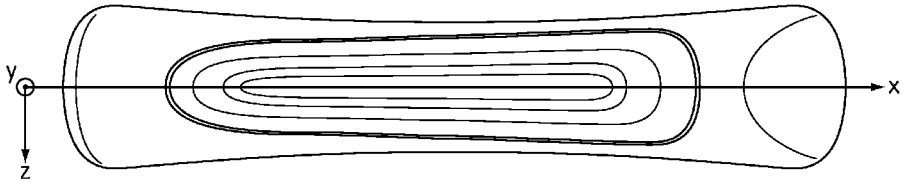
FIG. 6 is a top plan view like FIG. 2 marked with reference lines and planes.

In addition to azimuthal asymmetry, and in contrast to prior art weights, hand weight 10 is asymmetric with respect to other references. One way of describing the contrasts in symmetry is with respect to various planes defined by the xyz axes through a geometric centerpoint C of both the present invention and the prior art weight. The prior art weight, FIGS. 8-9, is symmetric with respect to all three planes: with respect to the xy plane through centerpoint C, with respect to the xz plane through centerpoint C, and the yz plane through centerpoint C. In contrast, hand weight 10 of the present invention is symmetric only with respect to the xy plane through centerpoint C. This symmetry is best seen in FIG. 6. Otherwise, hand weight is asymmetric with respect to the xz plane and the yz plane through centerpoint C. As noted above, this asymmetry is due to the opposing configuration of the weight protrusions and the angled body of the weight. In summary, hand weight 10 is asymmetrical with respect to all references except for the xy plane. Asymmetry with respect to the horizontal x axis, the longitudinal L axis, the xz plane and the yz plane provide result in the unique shape of hand weight 10. This resulting shape provides the needed weight resistance with an open design that accommodates a larger range of hand sizes and added clearance and comfort.

Figure 4:
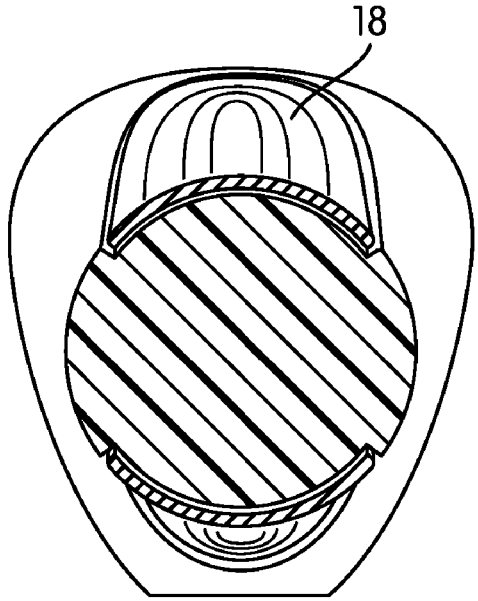
FIG. 4 is a cross-sectional view taken along line 4-4 of FIG. 1.

As seen in the cross-sectional view, FIG. 4, the center of the central grip portion has a generally circular shape. As described herein protrusions 14, 16 have generally triangular end profiles with the end surfaces canted at an angle α with respect to the horizontal. All of the transition surfaces between the central grip area and the weight protrusions are contoured to lend hand weight 10 a sleek and smooth overall appearance. These surface contours also provide a comfortable, ergonomic feel to the hand weight for any manner of hold and use. This is particularly true of holds other than a traditional grasp around the central grip area, such as when the user holds only an end either in the palm of the hand or hanging from ringed thumb and forefinger.

In keeping with the contours of the weight, each grip enhancing pad 18 has a contoured outer boundary as seen in FIG. 6. Hand weight 10 is formed with recesses for attaching pads 18 such that the outer surfaces are substantially flush and smooth. Pads 18 can be made of an array of thermoplastic resins. Attachment can be done in any suitable manner. The material for hand weight 10 is preferably a cast metal, but an iron or other material filled plastic can also be used as the core material. The surface can be polished, textured or treated with coatings or colors.

As recounted in the Background section, prior art cylindrical hand weights are prone to rolling and increasing the chance of injury. The asymmetric shape of hand weight 10 in and of itself prevents the likelihood of the weight rolling around. To positively set hand weight 10 on a flat surface, one of the tips is provided with a flattened area. As best seen in FIG. 1, tip 14*a* has a flattened area 20 which together with seat 16*b* enables hand weight 10 to be set stably on a flat surface.

While various embodiments of the invention have been described, it will be apparent to those of ordinary skill in the art that may more embodiments and implementations are possible that are within the scope of the invention.

What is claimed is:

1. A one-piece hand weight comprising a central grip area and weight protrusions disposed at ends thereof in opposing relation to one another with respect to said central grip area such that each weight protrusion comprises a seat portion flush with said central grip area and a distally extending tip portion wherein the tip portions of the weight protrusions point in opposite directions, each said seat portion being wider than said corresponding tip portion to impart a smoothly contoured triangular end profile to each of said weight protrusions, wherein said hand weight defines a longitudinal axis angled from the horizontal and one of said tip portions includes a flat surface that together with said opposing seat portion supports said hand weight when said hand weight is positioned lengthwise on a flat surface, and wherein all transition surfaces between said central grip area and said weight protrusions are smoothly contoured.

2. The hand weight of claim 1, further comprising a grip pad attached to a portion of said central grip area.

3. The hand weight of claim 2, further comprising a second grip pad attached to an opposing portion of said central grip area.

4. A one-piece hand weight comprising a body portion and a weight protrusion disposed in opposing relation to one another at each end thereof with respect to said body portion such that each said weight protrusion comprises a seat portion flush with said body portion and a distally extending tip portion wherein the tip portions of the weight protrusions point in opposite directions, each said seat portion being wider than said tip portion to impart a smoothly contoured triangular end profile to each of said weight protrusions, one of said tip portions includes a flat surface that together with said opposing seat portion supports said hand weight when said hand weight is in a rest position set lengthwise on a horizontal flat surface, wherein said hand weight defines a geometric centerpoint when said hand weight is in said rest position, and wherein a frame of reference is defined in said rest position including an x axis extending through said centerpoint, a y axis perpendicular to said x axis, and a z axis perpendicular to both said x and y axes, wherein said hand weight is a asymmetric with respect to an xz plane extending through said centerpoint, and wherein all transition surfaces between said central grip area and said weight protrusions are smoothly contoured.

5. The hand weight of claim 4, further comprising a grip pad attached to a portion of said body portion.

6. The hand weight of claim 5, further comprising a second grip pad attached to an opposing portion of said body portion.

7. The hand weight of claim 4, wherein said hand weight is asymmetric with respect to a yz plane extending through said centerpoint.

8. The hand weight of claim 4, wherein said hand weight defines a longitudinal axis through said centerpoint, and wherein said longitudinal axis is angled relative to said x axis.

9. The hand weight of claim 8, wherein said hand weight is asymmetric with respect to said longitudinal axis.

10. The hand weight of claim 8, wherein said longitudinal axis is angled relative to said x axis.

11. A one-piece hand weight comprising a body portion and a weight protrusion disposed at each end thereof in opposing relation to one another with respect to said body portion such that each said weight protrusion comprises a seat portion flush with said body portion and a distally extending tip portion such that the tip portions of the weight protrusions point in opposite directions, each said seat portion being wider than said corresponding tip portion to impart a smoothly contoured triangular end profile to each of said weight protrusions, wherein said hand weight includes a geometric centerpoint when said hand weight is in a rest position set lengthwise on a horizontal flat surface, said hand weight also defining a longitudinal axis through said centerpoint, and wherein a frame of reference is defined in said rest position including an x axis extending through said centerpoint, a y axis perpendicular to said x axis, and a z axis perpendicular to both said x and y axes, said longitudinal axis being angled relative to said x axis, wherein said hand weight is a asymmetric with respect to a yz plane extending through said centerpoint and asymmetric with respect to a xz plane extending through said centerpoint and asymmetric with respect to said longitudinal axis, one of said tip portions includes a flat surface that together with said opposing seat portion supports said hand weight when said hand weight is in said rest position, and wherein all transition surfaces between said central grip area and said weight protrusions are smoothly contoured.

12. The hand weight of claim 11, further comprising a grip pad attached to a portion of said body portion.

* * * * *